United States Patent [19]

Fox

[11] 4,248,413

[45] Feb. 3, 1981

[54] SHEET STACKING APPARATUS

[75] Inventor: John Fox, Newport Pagnell, England

[73] Assignee: Xerox Corporation, Stamford, Conn.

[21] Appl. No.: 963,866

[22] Filed: Nov. 27, 1978

[30] Foreign Application Priority Data

Nov. 30, 1977 [GB] United Kingdom ..... 49817/77

[51] Int. Cl.[3] ..... B42B 2/00

[52] U.S. Cl. ..... 270/53; 270/58; 271/184; 271/236; 271/303; 414/36

[58] Field of Search ..... 270/53, 37, 58; 271/251, 184, 225, 236, 302-304, 279, 250, 233, 185, 242; 414/36; 227/43, 44; 198/371, 456, 457, 631, 854, 858; 93/93 DP

[56] References Cited

U.S. PATENT DOCUMENTS

| | | | |
|---|---|---|---|
| 3,220,569 | 11/1965 | Willits | 271/185 |
| 3,536,318 | 10/1970 | Gay | 270/53 |
| 3,713,647 | 1/1973 | Tamura | 271/236 |
| 3,877,804 | 4/1975 | Hoppner | 271/236 |
| 3,997,154 | 12/1976 | Mol | 270/58 X |
| 4,015,843 | 4/1977 | Tennant | 271/240 |
| 4,073,391 | 2/1978 | O'Brien | 270/58 |

*Primary Examiner*—Edgar S. Burr
*Assistant Examiner*—A. Heinz
*Attorney, Agent, or Firm*—William A. Henry, II

[57] ABSTRACT

Stacking apparatus for stacking sheets in corner registration to form sets positioned with respect to a finishing device such as a stitcher or stapler. The apparatus comprises a stack support surface which is inclined downwardly towards an endless belt extending across the surface and which forms a registration stop. The belt aligns the sheets in one plane and full corner registration is achieved by driving the belt to feed the sheets against a second registration stop.

11 Claims, 6 Drawing Figures

SHEET STACKING APPARATUS

Figure 1:
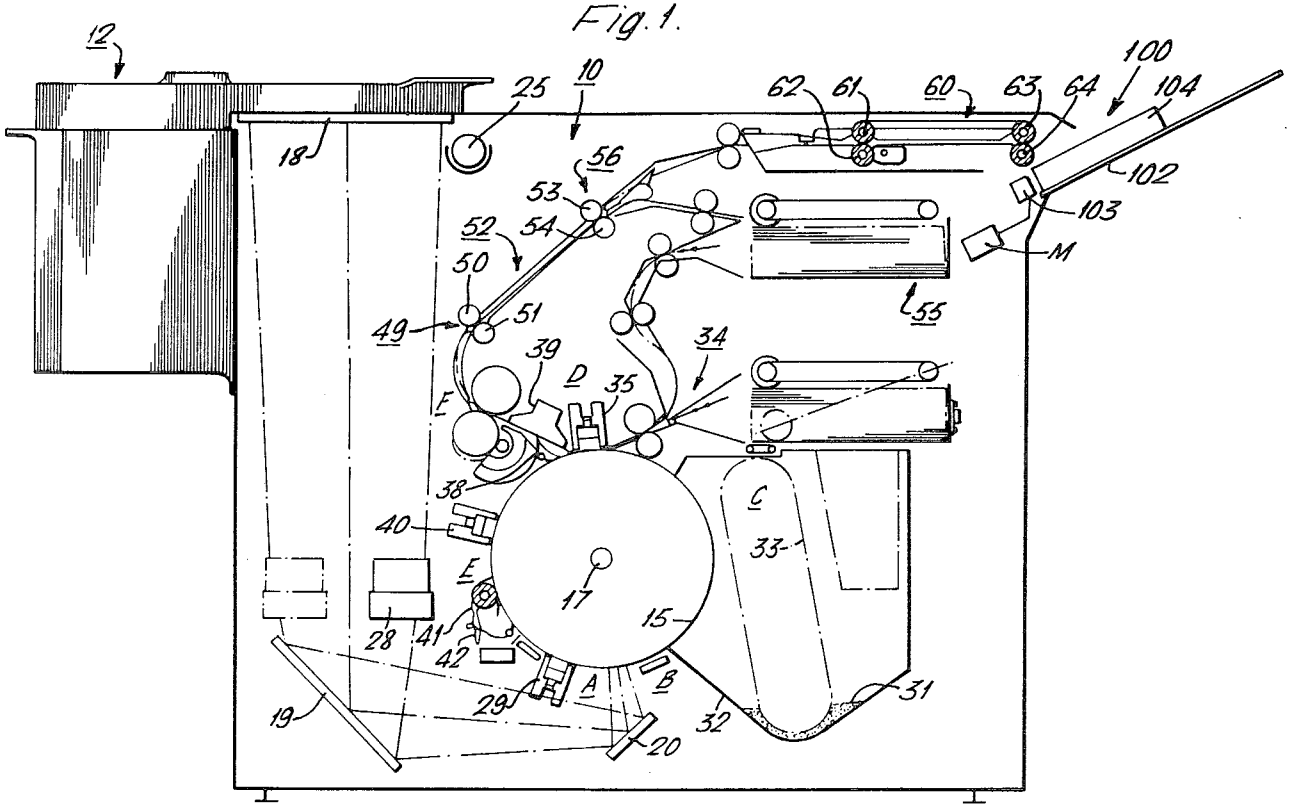

This invention relates to sheet handling apparatus and particularly to sheet stacking apparatus.

Stacking apparatus typically act on sheets fed serially thereto to stack the sheets in registration with each other so as to provide an attractive and compact set or signature with uniform edges. For complete registration the sheets need to be aligned both laterally and longitudinally with respect to the direction of travel of the sheets. This may be achieved by registering two adjacent edges (one end and one side) of the sheet with respect to respective registration stops and this form of registration is termed corner registration.

Stacking apparatus may be required in addition to compiling the sheets into sets to position the sheets with respect to a fixed finishing device such as a stitcher, stapler or punch. This is readily achieved by corner registration.

It is an object of the present invention to provide a stacking apparatus which corner registers sheets presented thereto.

To this end the invention consists in, from one aspect sheet, stacking apparatus comprising a support surface inclined downwardly towards a first registration stop in the form of an endless belt extending across the surface and adapted to be driven to feed a sheet in contact therewith towards a second registration stop.

The inclined support surface directs sheets delivered thereto to the belt which aligns the sheets in one plane and full corner registration is achieved by the belt conveying the sheet against the second stop which aligns the sheets in a second plane perpendicular to the first plane. In addition to providing a simple and positive corner registration stacking system, the stacking apparatus will accommodate a substantial offset between the registration corner and the sheet entering the stacker. Thus sheets can be received on the support surface at a distance from the second registration stop which is almost equal to the width of the sheets.

Conveniently, the belt extends transversely of the direction of travel of the sheets to the support surface in which case the belt serves as an end stop and side registers the sheet against the second stop. The support surface may be downwardly inclined downstream relative to the direction of sheet travel so that the front edges of the sheets are registered against the belt. Or, it may be downwardly inclined upstream so that the sheets pass over the belt as they are fed onto the support surface and reverse registered with their rear edges against the belt. An advantage of this latter arrangement is that it allows sheets of all sizes to be positively controlled right up to stacking. Thus, where the support surface is downwardly inclined downstream and the sheets are front edge registered against the belt, the distance a sheet travels after it is released by the conveying means, e.g. drive rollers, by which it is conveyed to the surface will depend on the length of the sheet, a small sheet travelling further than a large sheet. Where, however, the support surface is downwardly inclined upstream and rear edge registered, the distance travelled by all sheets after leaving the sheet conveying means will be the same (apart from slight differences due to inertia variations), regardless of the sheet size.

The tray is suitably inclined at an angle of 30 degrees or greater to the horizontal. In one preferred from the belt is arranged with its surface disposed vertically and so that edge of the stack will be square, the support surface extends towards the belt in a curve the end of which adjacent the belt is substantially horizontal. A curved support surface is useful for decurling curled sheets if it is curved in the opposite sense to that which the sheets tend to adopt.

The belt may be made of any material which provides the necessary frictional force on the sheet edges to effect registration by the belt yet allows the belt to slip against sheets which have been registered. The belt may be smooth or roughened.

The second stop may be displaceable to permit an assembled set to be conveyed off the support surface by the belt. Or the driving direction of the belt may be reversible and assembled sets conveyed off the side of the support surface opposite the second stop.

A particular application of the invention is in corner registering sheets exiting from a processor, such as a photocopier, in centre-line registration. Thus, the apparatus permits sheets of different sizes to be registered with respect to a common corner, so aligning the sheets to be acted upon by a fixed finishing device regardless of size. If the belt is reversible, a third stop may be provided at the side of the surface opposite the second stop. After registration against the second stop and insertion of a staple or stitch the belt may be reversed to register the set against the third stop followed by insertion of a second staple. This arrangement permits the symmetrical positioning of a pair of stitches or staples along one edge of a sheet independently of the sheet size. Depending on the sheet size relative to the width of the support tray this may be achieved by two fixed stitching or stapling devices, or by a single centrally located device.

Apparatus of this invention may also be used for offset stacking sheets in sets by providing two said second stops spaced in the direction of belt travel and alternately positionable for engagement by a sheet fed by the belt, and means for gripping completed sets.

For gripping the completed sets, the support surface is suitably pivotally mounted with its free end biased upwardly against a clamping member arranged to support the belt-engaging edges of the sheets, means being provided to push a completed set below the clamping member so that it is gripped between the support surface and the clamping member, which suitably extends the full width of the support surface. By pushing on the set to position it for clamping, the set is positively held throughout its movement and displacement of sheets in the set is avoided. Suitably the pusher is operatively connected to the stops so that each time the pusher is operated, the stops are repositioned.

In one preferred form of offset stacker of this invention, the pusher is a bail bar extending across the support surface and cantilevered off a shaft rotation of which in one direction displaces the second stops to disengage the one and engage the other. The stops, which are preferably double-ended and disposed perpendicularly to one another, are mounted on the shaft via a one-way clutch so that the stops are displaced during a rotation of the shaft corresponding to downward, pushing movement of the bail bar and unaffected during retraction of the bar.

Each completed set may of course be bound, e.g. by a stitcher or stapler, before it is displaced.

Figure 2:
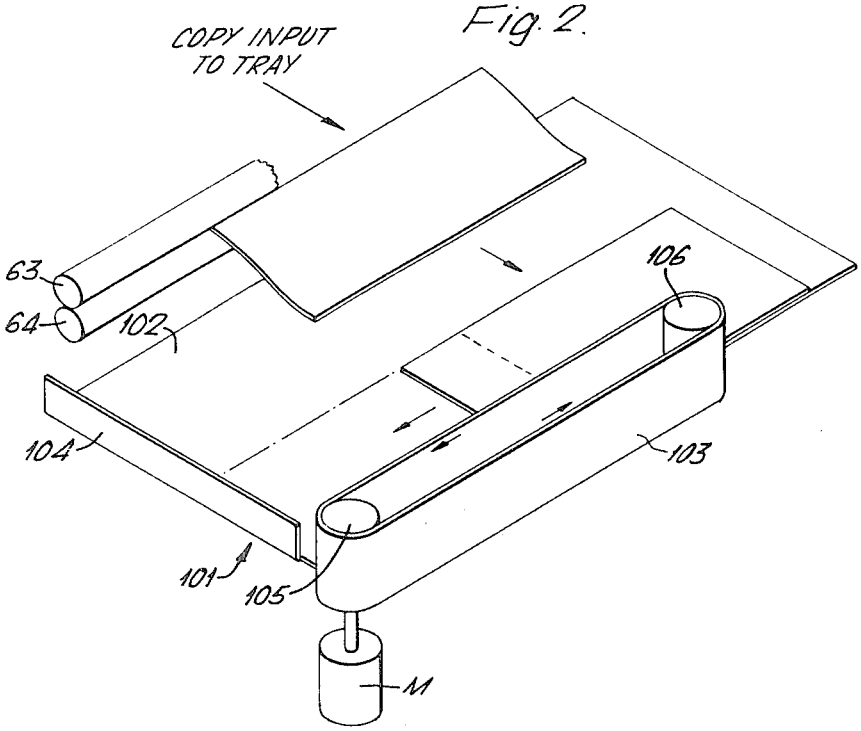
Figure 4:
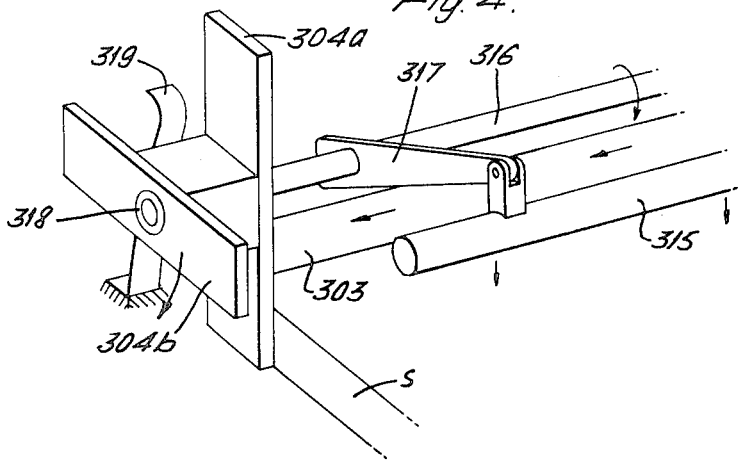
Figure 3:
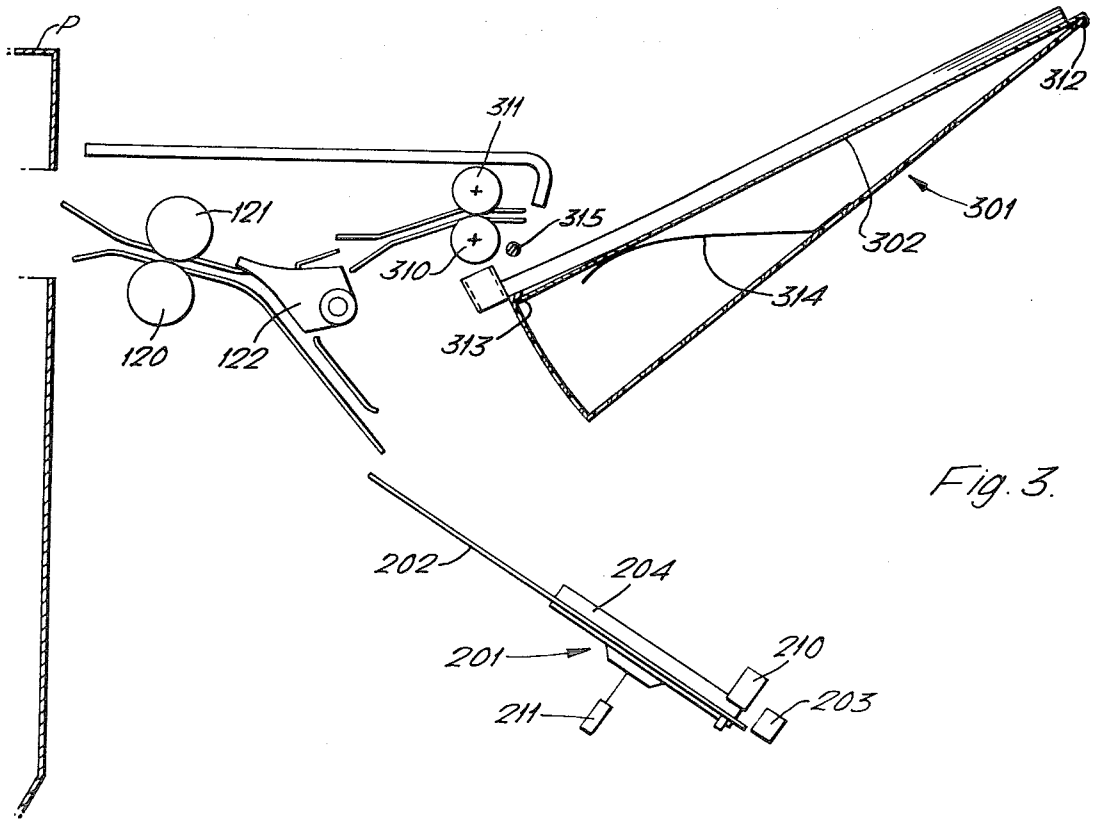
Figure 5:
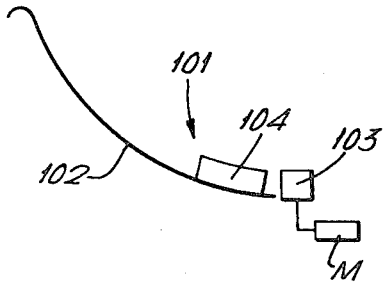
Figure 6:
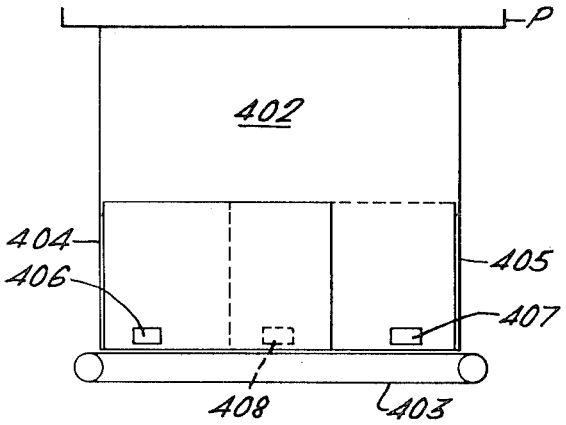

In order that the invention may be more readily understood, reference will now be made to the accompanying drawings, in which:

FIG. 1 shows an exemplary form of photocopier incorporating one embodiment of sheet stacker of this invention, FIG. 2 shows another form of the invention illustrating its mode of operation, FIG. 3 shows a finishing apparatus arranged to receive sheets from a processor and incorporating two further embodiments of sheet stacker of this invention, the upper of which is capable of performing offset stacking, FIG. 4 is a scrap view of the offset stacker of FIG. 3 showing greater detail, FIG. 5 shows another embodiment of sheet stacker of this invention, and FIG. 6 shows a still further embodiment of stacker arranged for side binding completed sets.

Referring to FIG. 1 there is shown an automatic xerographic reproducing machine 10 incorporating a sheet stacker 100 according to this invention. The copying machine 10 is capable of producing either simplexed or duplexed copies in sets from a wide variety of originals which may be advanced in recirculating fashion by recirculating document apparatus 12 described in U.S. Pat. No. 3,556,512. Although the present invention is particularly well suited for use in automatic xerography, the apparatus generally designated 100 is equally well adapted for use in any number of devices in which cut sheets of material are delivered in a set or stack and the set then separated from a previous set and forwarded to an output tray.

The processor 10 includes a photosensitive plate including a photoconductive layer that is placed over a conductive backing. The plate is formed in the shape of a drum 15 and the drum mounted on a shaft 17 that is journalled for rotation in the machine frame. The xerographic drum is rotated in the direction indicated so as to pass sequentially through a series of xerographic processing stations. The photosensitive drum and the xerographic processing apparatus are driven at predetermined speeds relative to each other from a single drive system (not shown) and the operations thereof coordinated in order to produce proper cooperation of the various processing mechanisms.

The document to be reproduced is transported by document handling apparatus 12 from the bottom of a stack to a transparent horizontally supported platen 18 and scanned by means of a moving optical scanning system to produce a flowing light image. After scanning the document is returned and the next advanced and scanned and so on until the entire document stack has been copied at which time the cycle may be repeated as described in the above patent. The scanning system includes an elongated horizontal extended aperture lamp 25 and a movable lens element 28. The lamp and lens element move in coordination across the document supported upon the platen to focus successive incremental bands of illumination reflected from the document onto the moving drum surface at synchronous speeds therewith. The optical path is folded by means of a pair of image mirrors 19 and 20 interposed between the lens and the drum surface and arranged to place the image on the drum at exposure station B. Prior to the imaging of the drum surface, the drum is first uniformly charged by means of a corona generator 29 positioned in charging station A. Under the influence of the flowing light image, the uniformly charged photoconductive surface is selectively dissipated in the non-imaged areas to form a latent electrostatic image.

The latent electrostatic image is carried on the drum surface from the exposure station into the developing station C where it is developed into visible form. Any of the various well-known xerographic systems of development may be utilised; the so-called cascade development system is illustrated in which two-component developer material 31 is transported by means of a bucket system 33 from the bottom of a developer housing 32 to an elevated position where it is caused to flow downwardly in contact with the upwardly moving drum surface, charged toner particles being attracted from the developer mix into the image areas on the plate surface.

The moving drum surface next transports the developed xerographic image to a transfer station D. Cut sheets of final support material are also moved into the transfer station from sheet registering apparatus 34 in synchronous relation with the image on the drum surface. In the transfer station, the back side of the copy sheet is sprayed with an ion discharge from a transfer corotron 35 inducing on the sheet a charge having a polarity and magnitude sufficient to attract the toner material from the drum surface to the final support material. This induced charge also electrostatically tacks the final support material to the drum surface. In order to remove the copy sheet from the drum surface, a stripper finger 38 is positioned downstream from the transfer corotron. The finger is arranged to move between the drum surface and the copy sheet and lifts the sheet from the drum surface. The stripped sheet is directed along a predetermined path of travel into contact with a stationary vacuum transport 39.

Residual toner remaining on the drum surface after transfer is removed into a cleaning station E comprising a cleaning corotron 40 and a brush in a housing 41 from which it is returned through tubes 42 to the developer housing for reuse.

The copy sheet, which has been removed from the drum surface after the transfer operation, is moved along stationary transport 39 into fusing station F to permanently bond the toner particles to the sheet.

Upon leaving the fuser, the fixed copy sheet is passed through a curvilinear sheet guide system, generally referred to as 49, into cooperating advancing rolls 50 and 51. The advancing rolls forward the sheets through a linear sheet guide system 52 into a second pair of advancing rolls 53 and 54. At this point, depending on whether simplex or duplex copies are desired, the simplexed copy sheet is either forwarded directly into apparatus 100 via transport 60 or into upper supply tray 55 by means of a movable sheet guide 56 before the finishing apparatus for the duplexed copy. Movable sheet guide 56, and associated advancing rolls are prepositioned by appropriate machine logic system to direct the individual sheets into the desired path.

The transport assembly 60 includes two sets of pinch rolls 61, 62 and 63, 64 which advance the sheets from.

The stacker 100 comprises a tray 101 having a base or support surface 102 which is inclined downwardly towards an endless belt 103 which extends across the surface 102 at its lower end. The belt forms an end registration stop for sheets delivered by the sheet transport 60 and is driven by a motor M to drive sheets in contact therewith towards a wall 104 of the tray which forms a side registration stop. Thus the inclined support surface 102 directs sheets fed serially thereto by transport 60 to the belt 103 which aligns the sheets in one plane and the belt conveys the sheets against the wall 104 to effect full corner registration. The support surface 102 may be inclined upstream relative to the direction of sheet as shown in FIG. 1 or it may be inclined downstream as shown in the alternative embodiment of FIG. 2. The belt is arranged perpendicular to the surface 102 and as shown in FIG. 2 is entrained over guide rollers 105, 106.

As will be seen from FIG. 2, the apparatus permits a substantial offset between the registration corner and the sheets entering the stacker. The offset is limited only by the requirement that subsequent sheets overlap the edges of the registered sheets. As also seen from FIG. 2 it is not necessary that the belt extend the full width of the tray 101.

The belt 103 may be made of any material, reinforced if necessary, capable of exerting the necessary frictional force on the sheet edges to transport the sheets up to the side registration stop 104, whilst also allowing the belt to slip against the sheets which have been corner registered. Thus the belt may be made of a natural or synthetic elastomer such as nitrile, butyl or polyurethane elastomer. A refinforced belt may be formed of rubberised fabric. The belt may have a smooth sheet-engaging surface or this surface may be roughened or fibrous, being of a fabric, such as velvet, for example.

In order to ensure that sheets delivered to the support surface 102 are directed into contact with the belt 103, and loaded against the belt, the surface 102 is preferably inclined at an angle of about 30 degrees or more to the horizontal. In FIGS. 1 and 2, the belt is arranged perpendicular to the surface 102 so that a stack formed on the surface has square edges. A surface arrangement which permits the belt not only to be perpendicular to the surface 102 but also to be disposed with its drive surface vertical, is shown in FIG. 6. In this arrangement the lower end of the surface 102 is horizontal and the necessary loading of the sheets against the belt is achieved by forming the surface into a concave curve. The curve may be of a fixed radius or the radius may reduce towards the upper end of the surface.

It will be realised that where the momentum of the sheet itself assists in carrying it to the belt 103 as in FIG. 2, the inclination of the surface 102 may be less than where there is no such assistance, as in FIG. 1. However the arrangement of FIG. 1 where the surface 102 is inclined upwardly in the direction of sheet flow from the processor so that the sheets pass over the belt as they are fed onto the surface has several advantages. Thus, user access to the stacked sheets is simplified since the belt is on the same side of the stack as the transport 60 which also assists in preventing accidental user contact with the belt. This arrangement further permits sheets of all sizes to be positively controlled to the same distance from the registration belt.

Referring now to FIG. 3, there are shown to further embodiments of sheet stacker according to the invention embodied in a finishing apparatus arranged to receive sheets exiting from a processor P such as a photocopier. The sheets are driven by feed rolls 120, 121 being directed either to upper collection tray 301 or lower collection tray 201 by a diverter 122. The lower tray 201 is primarily intended for stacking and binding the sheets in sets while the upper tray 301 is primarily intended for offset stacking the sheets.

Considering the lower tray 201 first this has a surface 202 inclined downwardly in the direction of sheet travel towards a belt 203 extending across its lower end. The belt is driven by a suitable motor to convey the sheets into corner registration with the wall 204. A stapler 210 is arranged to corner staple completed sets and the wall 204 is retractable to permit ejection of stapled sets into a suitable output tray by continued motion of the belt. Retraction of the wall 204 is effected by suitable mechanism represented here by a solenoid 211 which may be actuated manually or under the control of the processor logic. Instead of retracting the wall 204, the latter may be fixed and the direction of the belt may be reversed to drive the bound sets off the opposite side of the tray.

The upper stacking apparatus of FIG. 3 will now be described, reference also being had to FIGS. 4 and 5. The tray 301 has a support surface 302 inclined downwardly towards belt 303. The belt is arranged below a pair of feed rollers 310, 311 and the sheets are reverse registered against the belt. For offset stacking sheets, the side registration stop of the previously described embodiments is replaced by two stops 304*a* and 304*b* which are alternately positionable for engagement by the sheets and are spaced apart by a distance equal to the amount of offset required. In order to ensure that completed sets are not disturbed by further action of the belt 303, the completed sets are gripped in the following manner. The base 302 of the tray 301 is pivotally mounted at 312 and its free end is biased upwardly against a clamping plate 313 on which the leading edges of the sheets rest, by a leaf spring 314. A bail bar 315 extending across the surface 302 is normally disposed above the surface. When a set has been completed the bail bar 315 is driven downwards to press the lower edge of the set beneath the clamping plate 313. The bail bar is then retracted so that the set is gripped between the surface 302 and the plate 313. It will be noted that the sheets within a set will not be disturbed during this movement since the set is at all time positively held either between the surface 302 and the bar 315 or between the surface and the plate 313. The number of sets wich can be stacked in this way will depend upon the capacity of the tray 301.

Referring now to FIGS. 4 and 5, the bail bar 315 is cantilevered off a rotatably mounted shaft 316 on arms 317 (only one of which is visible in the scrap view of FIG. 4) which are fixed to rotate with the shaft. The stops 304*a*, 304*b* are mounted on one end of the shaft 316 through a one-way (Torrington) clutch 318. Suitable mechanism (not shown) is provided to drive the bar 315 downwards upon the completion of a set in response to a signal from the processor logic. The movement of the bar 315 corresponds to a quarter revolution of the shaft 316 so that the stops 304*a*, 304*b* are turned through 90 degrees each time the bar 315 is depressed. Consequently, the stops are double-ended as shown so that they are alternately positioned for sheet registrations. A square sectioned connection between the stops 304*a* and 304*b* is engaged by a leaf spring 319 positively to locate the stops after indexing.

The embodiment of stacker shown in FIG. 6 is adapted for side stapling or stitching of sets compiled therein. The stacker surface 402 inclined downwardly towards a corner registration belt 403 by which sheets delivered to the tray are conveyed against side registration wall 404. A further side registration wall 405 is arranged along the side of the tray opposite wall 404 and two fixed staplers or stitchers 406, 407 are arranged equal distance from the walls 404, 405 respectively. The belt 403 may be driven in either direction. In operation, sheets are compiled into a set against the wall 404. A completed set is stapled using the device 406. The belt is then reversed to convey the set against the wall 405 and a second staple is inserted using the device 407. The set is thus provided with two symmetrically disposed side staples using stationary binding devices. Instead of the two staplers, a single device 408, shown in broken lines, may be provided. However, such an arrangement is more dependent on sheet size than the dual arrangement shown in full lines.

Although specific embodiments have been described, it will be understood that various modifications may be made to the specific details referred to herein without departing from the scope of the invention as defined in the appended claims. For example, the belt may be intermittently driven either in response to the processor logic or in response to the detection of a sheet, e.g. by a sensor disposed at the entrance to the tray. The support surface in FIG. 6 is a concave curve; in an alternative form the curve may be convex.

What is claimed is:

1. Sheet stacking and aligning apparatus comprising a support surface inclined downwardly from the horizontal towards a first registration stop in the form of an endless belt extending across said support surface and having an elongated abutment surface for arresting movement of sheets sliding down said support surface, said support surface being adapted to guide a series of successively delivered sheets down along same such that an edge of the sheets individually or in a stack are aligned against said abutment surface, driving means adapted to move said abutment surface in a first driving direction parallel to its length to feed a sheet or stack of sheets in contact therewith towards a second registration stop extending transverse to and adjacent said first registration stop to intercept and align a second edge of each of the sheets, said driving means also being adapted to move said abutment surface in a second reverse direction opposite to said first driving direction for conveying a stack of aligned sheets off said support surface.

2. Apparatus according to claim 1 including third registration stop, whereby driving said belt in a first direction feeds a sheet in contact therewith towards said second registration stop and driving said belt is a second direction feeds a sheet towards said third stop.

3. Apparatus according to claim 2 in which a fixed binding device is disposed centrally between the second and third stops.

4. Apparatus according to claim 2 in which two binding devices are spaced equal distances from the second and third stops respectively.

5. Apparatus according to claim 1 having offset stacking of sheets including two second stops spaced in a direction of belt travel and alternately positionable for engagement by a sheet fed by the driven belt, and means for gripping completed sets.

6. Apparatus according to claim 5 in which, for gripping completed sets, the support surface is pivotally mounted at one end with an opposite end biased upwardly against a clamping member arranged to support the belt engaging edges of the sheets, means being provided to push a completed set below the clamping member so that it is gripped between the support surface and the clamping member.

7. Apparatus according to claim 6 in which the clamping member extends the width of the support surface.

8. Apparatus according to claim 6 in which the pusher means is operatively connected to said second stops so that each time the pusher is operated, the stops are repositioned.

9. Apparatus according to claim 6 in which the pusher means comprises a bail bar extending across the support surface and cantilevered off a shaft, rotation of which in one direction displaces the two second stops to disengage the one and engage the other.

10. Apparatus according to claim 9 in which the stops are mounted on the shaft via a one-way clutch so that the stops are repositioned during a rotation of the shaft corresponding to a downward set pushing movement of the bail bar and are unaffected by retraction of the bar.

11. Apparatus according to claim 1 including a fixed binding device.

* * * * *